United States Patent [19]

Du

[11] Patent Number: 4,957,220

[45] Date of Patent: Sep. 18, 1990

[54] VENDING MACHINE LAST DRINK SENSOR AND DISPENSING APPARATUS

[76] Inventor: Benjamin R. Du, 32392 Via Antibs, South Laguna, Calif. 92677

[21] Appl. No.: 280,679

[22] Filed: Dec. 6, 1988

[51] Int. Cl.[5] ..... B67D 5/08

[52] U.S. Cl. ..... 222/66; 222/23; 222/129.1; 222/278; 222/336

[58] Field of Search ..... 222/23, 52, 64–66, 222/129.1, 129.2, 129.3, 129.4, 249, 250, 95, 105, 386, 386.5, 278, 336

[56] References Cited

U.S. PATENT DOCUMENTS

| | | | |
|---|---|---|---|
| 2,509,570 | 5/1950 | Lee | 222/23 |
| 2,703,190 | 3/1955 | Muller | 222/66 X |
| 2,880,910 | 4/1959 | Hanson et al. | 222/65 |
| 2,954,146 | 9/1960 | Hullman | 222/66 X |
| 2,955,173 | 10/1960 | Kranz | 200/84 |
| 3,351,238 | 11/1967 | Gilbertson | 222/23 |
| 3,537,616 | 11/1970 | Diebel et al. | 222/66 |
| 3,738,775 | 6/1973 | Strickland | 222/95 X |
| 3,787,829 | 1/1974 | Schneier | 222/66 X |
| 3,981,414 | 9/1976 | Gust et al. | 222/66 X |
| 4,247,018 | 1/1981 | Credle | 222/1 |
| 4,406,382 | 9/1983 | Roth | 222/23 X |
| 4,484,697 | 11/1984 | Fry, Jr. | 222/95 |
| 4,645,095 | 2/1987 | Coppola | 222/64 |
| 4,790,458 | 12/1988 | Moore | 222/146.5 |

*Primary Examiner*—Kevin P. Shaver

*Attorney, Agent, or Firm*—Stetina and Brunda

[57] ABSTRACT

A last drink sensor and dispensing apparatus for use in beverage dispensing bag-in-box vending machines is disclosed. The sensor and dispensing apparatus is disposed between the pump and dispensing nozzle of the vending machine and operates to sense the cessation of syrup flow from the pump caused by a depletion of syrup within the bag-in-box storage reservoir, and then activate the "sold out" selection light for the depleted fluid reservoir of the vending machine, trigger the coin changer mechanism of the vending machine to refuse coins for the "sold out" fluid selection, and also activate the timer of the vending machine to dispense the last full drink of the selected beverage from the vending machine.

14 Claims, 2 Drawing Sheets

VENDING MACHINE LAST DRINK SENSOR AND DISPENSING APPARATUS

Field of the Invention

The present invention relates generally to fluidic pumping and dispensing systems and more particularly to a last drink sensor and dispensing apparatus for particular use in beverage dispensing bag-in-box vending machines. A sensor/accumulator device is disposed between the pump and dispensing nozzle of the vending machine which automatically senses cessation of fluid flow from the pump indicative of depletion of syrup from the bag-in-box storage reservoir; activates the "sold out" selection light for the depleted syrup reservoir of the vending machine; triggers the coin changer mechanism of the vending machine to refuse coins for the "sold out" beverage selection and dispenses the last full drink of the selected beverage from the vending machine.

Background of the Present Invention

As is well known, a variety of beverages, such as carbonated beverages, are marketed to retail consumers by coin-operated vending machines. Heretofore such prior art beverage dispensing vending machines have included plural stainless steel storage reservoirs, each of which is adapted to store a quantity of differing flavored syrup for dispensing to the mixing nozzle wherein a proportional quantity of carbonated water is mixed with the flavored syrup and dispensed into a cup for the user. The motive force for delivering a particular flavored beverage syrup has typically been effectuated by a pressurized source of carbon dioxide gas which is supplied to the interior of the stainless steel storage reservoir. Upon encountering a syrup depletion condition within the stainless steel tank, the carbon dioxide gas follows the beverage syrup and travels from the storage reservoir toward the nozzle. So as to insure that a properly proportioned last drink is dispensed from the vending machine, such prior art beverage dispensing vending machines have incorporated an electronic last drink sensor disposed between a stainless steel syrup reservoir and the dispensing nozzle which is adapted to sense the presence of carbon dioxide gas within the dispensing system. Upon sensing of the presence of carbon dioxide gas, the sensor activates the "sold out" selection light upon the vending machine, additionally triggers the coin box mechanism to reject further coins for the depleted beverage selection and finally allows dispensing of the last drink from the reservoir. Such carbon dioxide detection electronic sensors are extremely costly and further are only available to effectively operate when carbon dioxide is utilized as the motive force for such dispensing machines.

In recent years, the beverage industry has begun supplying flavored syrups in collapsible bag-in-box containers which are preferable in relation to sanitation and economics to the prior art stainless steel tank reservoir systems. In this regard, the beverage syrup is supplied within a plastic liner disposed within the interior of a cardboard or paperboard box which may be rapidly disposed of in a sanitary manner after use. Although such bag-in-box containers have been utilized extensively in food service beverage dispensing systems, they have generally been incapable of use in beverage dispensing vending machine systems since the beverage syrup contained within the bag-in-box container is hermetically sealed within the interior of the plastic liner of the bag and typically is pumped via a positive displacement pump from the bag-ub-box container to a dispensing nozzle. Further, since the use of bag-in-box syrup containers prevents the dispensing of the syrup by way of carbon dioxide gas, the conventional vending machine carbon dioxide electronic last drink sensors are incapable of proper functioning in such bag-in-box container systems.

As such, there exists a substantial need in the art for a bag-in-box beverage dispensing system which can be utilized on conventional vending machines to allow the improved sanitation and economics attendant with bag-in-box syrup storage containers.

Summary of the Present Invention

The present invention specifically addresses and alleviates the above-referenced need associated in the art. More particularly, the present invention comprises a last drink sensor and dispensing apparatus for particular use in beverage dispensing bag-in-box vending machines. The apparatus includes a sensor/accumulator device disposed between the pump and dispensing nozzle of the vending machine adapted to automatically sense cessation of fluid flow from the pump which is indicative of a depletion condition existing within the bag-in-box storage reservoir. Upon detection of such depletion condition, the sensor/accumulator device provides a switching signal which activates the "sold out" selection light for the depleted bag-in-box container of the vending machine; triggers the coin changer mechanism of the vending machine to refuse coins for the sold out beverage selection, and activates the timer mechanism of the vending machine to allow dispensing of the last full drink of the selected beverage from the vending machine.

In the preferred embodiment, the bag-in-box syrup storage reservoir is connected via conduit to a positive displacement fluidic pump which serves to draw syrup from the interior of the bag-in-box container and deliver the same to the flow control mixing and dispensing nozzle of the vending machine. In the preferred embodiment, the fluidic pump is operated by a source of carbon dioxide gas, however, such carbon dioxide gas is physically isolated from the beverage syrup contained within the bag-in-box container. Disposed between the outlet port of the pump and the flow control mixing and dispensing nozzle of the vending machine is a pressure actuated sensor/accumulator device comprising a fluid accumulator chamber and spring biased piston arrangement. The spring constant is specifically selected so as to be overcome by normal system pressure generated by the pump yet upon experiencing a reduction in system pressure caused by cessation of syrup flow from the pump (indicative of a fluid depletion condition), the spring constant is sufficient to reciprocate the piston within the accumulator chamber, thereby dispensing a quantity of syrup to the fluid control mixer and dispensing nozzle sufficient to supply the last drink from the vending machine.

In the preferred embodiment, the piston and housing of the sensor/accumulator device is provided with a microswitch preferably comprising a single pole double throw switch which when closed provides a switching signal indicating that sufficient syrup remains in the bag-in-box storage container to allow continued dispensing and when opened generates a switching signal utilized by the conventional circuitry of the vending machine to activate the "sold out" selection light for the vending machine, trigger the coin changer to refuse coins for the sold out selection, and permits the timer for the vending machine to allow delivery and proper dispensing of the last full drink for the selected beverage.

The accumulator chamber of the sensor/accumulator device is sized to hold a sufficient quantity of beverage syrup therein to dispense sufficient syrup for the size drink supplied by the vending machine. Since a one-cup beverage size is typically dispensed from most conventional vending machines, and further since there is a five-to-one water-to-syrup ratio for most such dispensed beverages, the accumulator chamber is sized to store a quantity of approximately one ounce of syrup therein. For differing sized vending machines, however, a larger accumulator chamber is contemplated to permit dispensing of larger sized drinks from the vending machine.

In the preferred embodiment, the sensor/accumulator device is provided with a rolling diaphragm mounted adjacent the end of the piston which provides a dynamic seal between the piston and chamber. As such, during reciprocation of the piston within the accumulator chamber, the piston sweeps a known area with a stroke sufficient to deliver an appropriate quantity of syrup from the chamber for the last drink of the vending machine. A second preferred embodiment of the sensor-/accumulator utilizes a cylinder piston arrangement wherein the accumulator chamber is sealed by a sliding O-ring.

Description of the Drawings

These as well as other features of the present invention will become more apparent upon reference to the drawings wherein.

Detailed Description of the Preferred Embodiment

Figure 1:
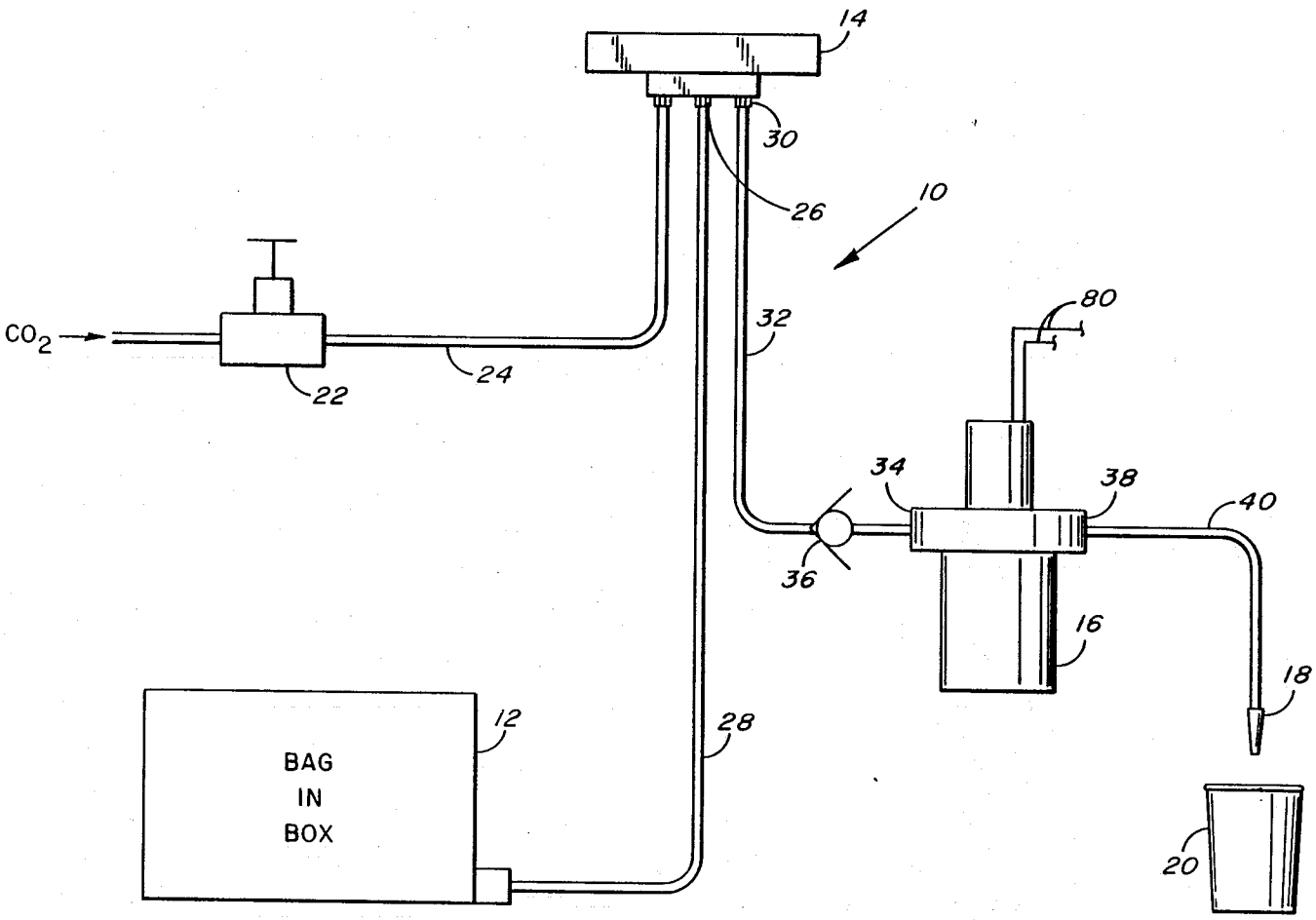
FIG. 1 is a schematic view of the vending machine last drink sensor and dispensing apparatus of the present invention.

Referring to FIG. 1, there is shown a schematic representation of the vending machine last drink sensor and dispensing apparatus 10 of the present invention composed generally of a syrup storage reservoir 12, a pump 14, a sensor/accumulator device 16, and fluid control mixing nozzle 18 which is incorporated within a conventional beverage dispensing vending machine (not shown) having a conventional coin changer mechanism (not shown), beverage selection circuitry (not shown), and sold out selection lights (not shown). In the preferred embodiment, the storage reservoir 12 comprises a collapsible bag-in-box syrup container, such as that currently utilized in the beverage syrup food service trade and which stores a quantity of flavored beverage syrup, such as cola syrup and/or lemon-lime syrup which is mixed via the nozzle 18 with a proportional quantity of carbonated water to form a resultant beverage. As is well known, as the syrup is removed from the bag-in-box container 12, a flexible liner maintained within the interior of the bag-in-box container 12 collapses downwardly towards the lower-most end of the container 12 with any air maintained within the liner rising to the upper-most portion of the liner.

In the preferred embodiment, the pump 14 comprises a positive displacement fluidic pump preferably powered by a supply of carbon dioxide gas maintained within the vending machine via a pressure regulator 22 and conduit line 24. As will be recognized, the carbon dioxide gas is utilized to a motive force for the fluidic motor 14 but is isolated from the beverage syrup throughout the pumping cycle. The inlet port 26 of the pump 14 is connected via a conduit 28 to the outlet of the bag-in-box container 12 while the outlet port 30 of the pump 14 is connected via a conduit 32 to the inlet port 34 of the sensor/accumulator device 16. In the preferred embodiment, the fluidic pump 14 includes an integral check valve (not shown) adjacent its outlet port 30 or alternatively a conventional check valve 36 may be disposed upon conduit 32 between the outlet port 30 of the pump 14 and inlet port 34 of the sensor/accumulator 16. The outlet port 38 of the sensor/accumulator device 16 is connected via conduit 40 to a conventional flow control mixing nozzle 18, which nozzle 18 is additionally connected to a source of carbonated water or the like (not shown).

As a basic operational overview, the improved apparatus 10 of the present invention permits syrup contained within the container 12 to be drawn by the pump 14 through conduit 28 by suction created by the pump 18 and subsequently be discharged under pressure through the conduit 32, sensor/accumulator device 16, and nozzle 18 wherein the syrup is mixed with a proportional quantity of carbonated water or the like to form a resultant beverage that is supplied to a drinking cup 20. Although in the preferred embodiment, beverage syrup and carbonated water is utilized in the apparatus 10, it will be recognized that the present invention is additionally applicable to other dispensed beverages, such as wine, tea, and fruit juice concentrates, and for the purpose of this application, the terms syrup and mixing fluid shall be defined to include such other beverages, concentrates, and their appropriate mixing fluids.

Referring more particularly to FIGS. 2–5, the detailed construction and operation of the sensor/accumulator device 16 may be described. In the preferred embodiment, the device 16 is formed having a generally cylindrical housing formed of a pair of housing components 50 and 52 which define a cylindrical accumulator chamber 54 therebetween. A piston 56 is mounted for axial reciprocal movement within the interior of the housing components 50 and 52 and cooperates with a biasing means or spring 58, opposite ends of which are captured upon the piston 56 and housing segment 52. Dynamic sealing means such as a rolling diaphragm 60 is disposed within the accumulator chamber 54, the peripheral portion of which are captured between the housing segments 50 and 52 and the central portion of which is rigidly affixed to the frontal surface 62 of the piston 56. The inlet port 34 and outlet port 38 extend through the housing segment 50 and into the interior of the accumulator chamber 54. A microswitch 70 is positioned within the interior of the housing segment 52 having a first contact 72 disposed on the distal end of the piston 56 and a second contact 74 positioned upon the housing segment 52 such that when the piston 56 is disposed in its normal operating position depicted in FIGS. 2 and 3, the contacts 72 and 74 are tightly abutted together and form an electrical interface. In the preferred embodiment, the microswitch 70 comprises a single pole double throw microswitch which is connected via suitable cables 80 to the vending machine "sold out" selection light circuitry, coin changer circuitry, and timer circuitry (not shown).

In the preferred embodiment, the spring constant of the biasing spring 58 is selected such that the pressure exerted by the piston 56 and diaphragm 60 within the accumulator chamber 54 is less than the effective system pressure provided by the pump 14. As such, during normal pump operation, system pressure existing within the accumulator chamber 54 serves to force the piston 56 axially from left to right, as viewed in FIG. 2 whereby the contacts 72 and 74 of the microswitch 70 are maintained in an abutted electrical interface. The spring constant 58, however, is additionally selected such that if the system pressure decreases, such as when a fluid or syrup depletion condition exists in the bag-in-box container 12 and the pump 14 ceases to pump syrup, the biasing spring 58 has sufficient biasing force to cause the piston to reciprocate from right to left, as viewed in FIG. 2, whereby the quantity of syrup existing within the accumulator chamber 54 is dispensed through the outlet port 38 of the device 16.

In the preferred embodiment, the accumulator chamber 54 is sized to store a sufficient quantity of syrup therein to provide a proper amount of syrup for the last drink dispensed from the vending machine. In this regard, for a resultant dispensed beverage of approximately one cup, i.e. six fluid ounces, assuming a syrup/-mixing fluid mixing ratio of approximately 5 to 1, i.e. five parts mixing fluid to one part syrup, the accumulator chamber 54 is sized to store slightly more than one ounce of syrup therein. Additionally, the stroke of the piston 56 is regulated to insure that at least one ounce of syrup is dispensed from the accumulator chamber 54 during reciprocal travel of the piston 56 within the chamber 54.

Figure 3:
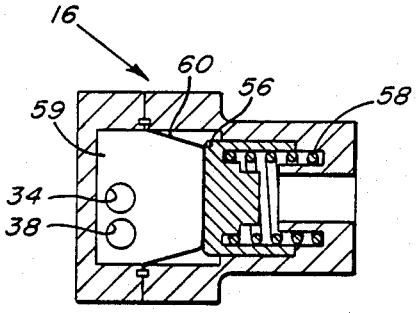
FIG. 3 is a schematic cross-sectional view depicting the piston and diaphragm of the sensor/accumulator device of FIG. 2 in its normal operating orientation.
Figure 4:
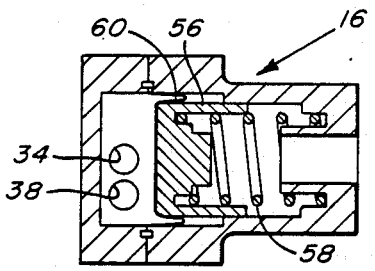
FIG. 4 is a schematic cross-sectional view illustrating the piston and diaphragm of the sensor/accumulator device during a dispensing operation with the piston/-diaphragm being disposed intermediate the accumulator chamber.
Figure 5:
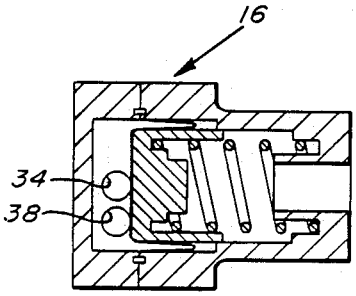
FIG. 5 is a schematic cross-sectional view depicting the piston/diaphragm of the sensor/accumulator device at the end of the piston stroke.

Referring more particularly to FIGS. 3, 4, and 5, the sequential operation of the sensor/accumulator device 16 of the present invention disposed within the dispensing system of FIG. 1 is illustrated. Initially, when the pump 14 is activated to pump syrup from the bag-in-box container 12 to the nozzle 18, system pressure within the accumulator chamber 54 is sufficient to overcome the biasing force of the spring 58 and thereby maintain the piston 56 and diaphragm 60 in their fully retracted normal operating position indicated in FIG. 3. As will be recognized, when disposed in this normal operating position, the contacts 72 and 74 of the microswitch 70 are abutted, i.e. closed, such that the vending machine coin changer and beverage dispensing selection circuitry functions to allow selective dispensing of fluids from the vending machine.

Upon depletion of the syrup contained within the bag-in-box reservoir 12, the pump 14 will cease to pump fluid into the accumulator chamber 54 whereby the pressure within the chamber 54 will decrease. Upon experiencing such a pressure reduction within the accumulator chamber 54, the biasing force provided by the spring 58 will cause the piston 56 to axially move from right to left, as depicted in FIG. 4 wherein the diaphragm 60 will roll upon itself and the syrup fluid contained within the interior of the accumulator chamber 54 will be dispensed by reciprocation of the piston 56 through the exit port 38 of the device 16. Upon initial travel of the piston from its position shown in FIG. 3 to that shown in FIG. 4, the contacts 72 and 74 of the microswitch 70 will be separated wherein an electrical switching signal will be sent via the connectors 80 to the vending machine circuitry to activate the "sold out" selection light for the depleted bag-in-box container 12, trigger the coin changer mechanism of the vending machine to refuse further coins for the sold out selection, and activate the timer circuitry of the vending machine to allow proper dispensing of the last full drink of the selected reservoir from the vending machine.

The piston 56 will continue to reciprocate axially from right to left from its FIG. 4 position to that position shown in FIG. 5 wherein the piston 56 is at the end of its stroke. As will be recognized, the stroke of the piston 56 is sized to insure that a proper amount of syrup will be dispensed from the accumulator chamber 54 throughout the piston travel to insure that the last drink dispensed from the vending machine has sufficient syrup to provide proper mixture at the nozzle 18. Upon completion of the piston's stroke, the piston 56 will remain in its orientation depicted in FIG. 5 until such time as a new bag-in-box container 12 is installed in the system whereby upon the pumping of fluid from the container 12 via the pump 14 into the accumulator chamber 54, the piston will then again return to its orientation depicted in FIG. 3 for continued operation.

Figure 2:
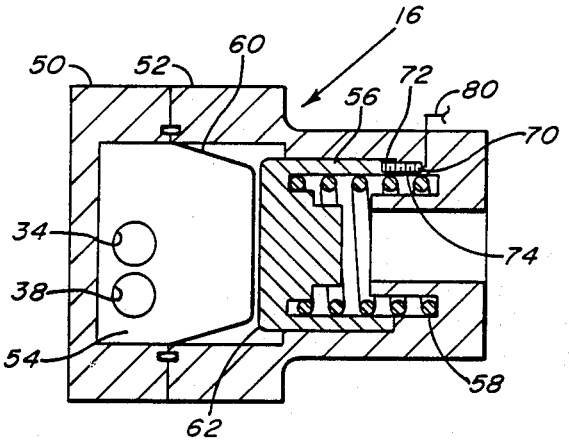
FIG. 2 is a cross-sectional view of the sensor/accumulator device of the present invention.

The flow control mixing and dispensing nozzle 18 controls the flow of syrup therethrough by a valve. By controlling the flow of syrup through the flow control mixing and dispensing nozzle 18, pressure can be maintained within the sensor/accumulator 16 such that the piston 56 can be maintained in its retracted or normal operating position as depicted in FIGS. 2 and 3.

From the above, it will be recognized that the present invention comprises a dispensing apparatus which is inexpensive in construction and further is pressure-actuated to sense the depletion of syrup in the bag-in-box container 12. Further, it will be recognized that by use of the sensor/accumulator device 16, a sufficient quantity of syrup will be constantly maintained within the accumulator chamber 54 during normal operation and subsequently will be dispensed via the spring 58 and piston 56 on the last drink provided by the vending machine. As such, the present invention allows effective utilization of bag-in-box containers 12 within a conventional beverage dispensing vending machine.

Figure 6:
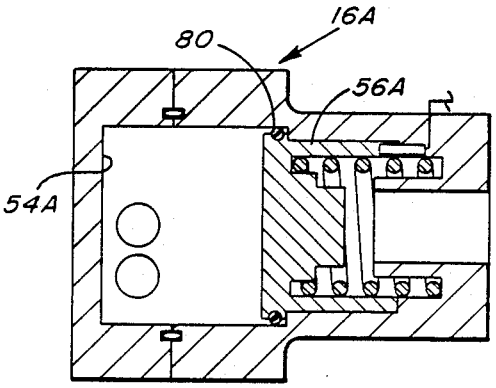
FIG. 6 is a cross-sectional view of a second embodiment of the sensor/accumulator device of the present invention.

Referring to FIG. 6, an additional embodiment of the sensor/accumulator device 16 of the present invention is disclosed. In this embodiment, the sensor/accumulator device 16A is formed and operates in a manner analogous to that described in relation to FIGS. 2–5, however, the rolling diaphragm 60 is replaced by a conventional O-ring seal 80 which is disposed about the periphery of the piston 56A to form a sliding, i.e. dynamic, seal between the piston 56A and the cylindrical walls of the accumulator chamber 54A. As will be recognized, however, the piston 56A functions in a manner analogous to that described in relation to FIGS. 2–5 to accumulate and dispense syrup within the accumulator chamber 54 sufficient to provide a proper quantity of syrup necessary for the last drink dispensed from the vending machine.

Those skilled in the art will recognize that although certain configurations and descriptions have been made herein, various modifications to the same can be made without departing from the spirit of the present invention and such modifications are clearly contemplated herein.

What is claimed is:

1. A beverage syrup dispensing apparatus for use in vending machines comprising:

a bag-in-box beverage syrup container adapted to store beverage syrup therein;

a nozzle formed to dispense said beverage syrup with a proportional quantity of a mixing fluid;

a pump disposed between said beverage syrup container and said nozzle for delivering syrup from said container to said nozzle; and means disposed between said pump and said nozzle for accumulating and dispensing a quantity of said syrup to said nozzle sufficient for vending at least one last beverage from said vending machine after a syrup depletion condition occurs within said bag-in-box syrup container, the syrup depletion condition occurring when said bag-in-box beverage syrup container becomes substantially empty of beverage syrup;

wherein the syrup depletion condition causes said means to dispense at least one beverage from said vending machine.

2. The apparatus of claim 1 wherein said accumulating and dispensing means comprises:

a chamber sized to accumulate therein said sufficient quantity of syrup;

a piston reciprocal along the length of said chamber for dispensing said quantity of syrup from said chamber; and means for reciprocating said piston through said chamber upon encountering a syrup depletion condition existing within said bag-in-box syrup container.

3. The apparatus of claim 2 wherein said reciprocating means comprises a spring adapted to bias said piston in a first reciprocating direction within said chamber.

4. The apparatus of claim 3 wherein said spring is sized to provide a biasing force sufficient to reciprocate said piston in said first reciprocating direction only upon encountering a syrup depletion condition existing within said bag-in-box syrup container.

5. The apparatus of claim 4 wherein said piston includes means for providing a dynamic seal between said piston and said chamber.

6. The apparatus of claim 5 wherein said dynamic sealing means comprises a rolling diaphragm mounted to said piston and said chamber.

7. The apparatus of claim 5 wherein said dynamic sealing means comprises an O-ring disposed between said piston and said chamber.

8. The device of claim 5 further comprising means cooperating with said piston for providing a switching signal dependent upon the position of said piston within said chamber.

9. The device of claim 8 wherein said switching signal means comprises a single pole double throw switch.

10. A sensor/accumulating device for use in a vending machine beverage syrup dispensing apparatus having a bag-in-box syrup container; a mixing nozzle; and a pump for delivering syrup from said bag-in-box container to said nozzle comprising:

a housing defining a chamber having an inlet adapted to be in flow communication with said pump and an outlet adapted to be in flow communication with said nozzle;

a piston adapted for reciprocal movement along the length of said chamber;

means cooperating with said piston for reciprocating said piston in a first reciprocating direction along the length of said chamber to dispense a quantity of syrup from said chamber upon encountering a reduction in pressure existing within said chamber; and means cooperating with said piston for providing a switching signal dependent upon the position of said piston within said chamber;

wherein said means cooperating with said piston for providing a switch signal causes the dispensing of the syrup disposed within the chamber of said sensor/accumulator when pressure is reduced within the chamber.

11. The device of claim 10 wherein said piston includes means for providing a dynamic seal between said piston and said chamber.

12. The device of claim 11 wherein said dynamic sealing means comprises a rolling diaphragm mounted to said piston and said chamber.

13. The device of claim 11 wherein said dynamic sealing means comprises an O-ring disposed between said piston and said chamber.

14. The device of claim 13 wherein said switching signal means comprises a single pole double throw switch.

* * * * *